US009000313B2

(12) United States Patent
Pan

(10) Patent No.: US 9,000,313 B2
(45) Date of Patent: Apr. 7, 2015

(54) SCISSORS-TYPE CONNECTING MEMBER AND KEY STRUCTURE WITH SCISSORS-TYPE CONNECTING MEMBER

(71) Applicant: Primax Electronics Ltd., Neihu, Taipei (TW)

(72) Inventor: Guo-Ping Pan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 126 days.

(21) Appl. No.: 13/801,656

(22) Filed: Mar. 13, 2013

(65) Prior Publication Data

US 2014/0138224 A1 May 22, 2014

(30) Foreign Application Priority Data

Nov. 22, 2012 (CN) ..... 2012 1 0477233

(51) Int. Cl.
*H01H 3/12* (2006.01)
*H01H 13/7065* (2006.01)

(52) U.S. Cl.
CPC ..... *H01H 3/125* (2013.01); *H01H 13/7065* (2013.01); *H01H 2215/006* (2013.01)

(58) Field of Classification Search
CPC ..... H01H 3/125; H01H 13/25
USPC ..... 200/5 A, 344
See application file for complete search history.

(56) References Cited

U.S. PATENT DOCUMENTS

| | | | | |
|---|---|---|---|---|
| 6,958,458 | B1 * | 10/2005 | Tsai | 200/344 |
| 7,183,512 | B2 * | 2/2007 | Lee et al. | 200/344 |
| 7,332,687 | B2 * | 2/2008 | Liu | 200/344 |
| 8,080,744 | B2 * | 12/2011 | Yeh et al. | 200/5 A |
| 8,581,130 | B2 * | 11/2013 | Jhuang et al. | 200/344 |
| 2014/0138224 | A1 * | 5/2014 | Pan | 200/344 |

* cited by examiner

*Primary Examiner* — Edwin A. Leon
*Assistant Examiner* — Ahmed Saeed
(74) *Attorney, Agent, or Firm* — Kirton McConkie; Evan R. Witt

(57) ABSTRACT

A key structure with a scissors-type connecting member is provided. The key structure includes a base plate, a scissors-type connecting member, and a keycap. The scissors-type connecting member includes a first frame and a second frame. The first frame includes a rotating shaft and an extension structure. The extension structure is extended from a first sidewall of the first frame to a ring-shaped periphery of the rotating shaft for enhancing a structural strength of the rotating shaft. The second frame includes a receiving recess for accommodating the rotating shaft and the extension structure.

13 Claims, 6 Drawing Sheets

SCISSORS-TYPE CONNECTING MEMBER AND KEY STRUCTURE WITH SCISSORS-TYPE CONNECTING MEMBER

FIELD OF THE INVENTION

The present invention relates to an input device, and more particularly to a key structure of a scissors-type connecting member.

BACKGROUND OF THE INVENTION

Generally, the widely-used peripheral input device of a computer includes for example a mouse device, a keyboard device, a trackball device, or the like. Via the keyboard device, the user may directly input characters and symbols into the computer. As a consequence, most users and most manufacturers of the input devices pay much attention to the keyboard devices.

Hereinafter, the configurations and the functions of a conventional keyboard device will be illustrated with reference to FIG. 1. FIG. 1 is a schematic top view illustrating the outward appearance of a conventional keyboard device. As shown in FIG. 1, plural keys 10 are installed on a surface of the conventional keyboard device 1. These keys 10 are classified into some types, e.g. ordinary keys, numeric keys and function keys. When one or more keys 10 are depressed by the user's fingers, a corresponding electronic signal is issued to the computer, and thus the computer executes a function corresponding to the depressed key or keys. For example, when an ordinary key is depressed, a corresponding English letter or symbol is inputted into the computer. When a numeric key is depressed, a corresponding number is inputted into the computer. In addition, the function keys (F1~F12) can be programmed to cause corresponding application programs to provide certain functions.

Hereinafter, the components of a key structure of the conventional keyboard device will be illustrated with reference to FIG. 2. FIG. 2 is a schematic exploded view illustrating a key structure of a conventional keyboard device. As shown in FIG. 2, the key structure 2 comprises a keycap 21, a scissors-type connecting member 22, an elastic element 23, a membrane switch circuit 24, and a base plate 25. The keycap 21 may be touched and depressed by the user. In addition, the keycap 21 is connected with the scissors-type connecting member 22. The scissors-type connecting member 22 is arranged between the keycap 21 and the base plate 25. In addition, the scissors-type connecting member 22 is connected with the keycap 21 and the base plate 25. The scissors-type connecting member 22 comprises an inner frame 221 and an outer frame 222. The inner frame 221 has a rotating shaft 2211. The outer frame 222 has two openings 2221 corresponding to the rotating shaft 2211. After the rotating shaft 2211 is penetrated through the openings 2221, the inner frame 221 and the outer frame 222 are connected with each other, and the inner frame 221 is swingable relative to the outer frame 222. The membrane switch circuit 24 is disposed on the base plate 25. The elastic element 23 is arranged between the keycap 21 and the membrane switch circuit 24. When the keycap 21 is depressed, the elastic element 23 is deformed downwardly to trigger the membrane switch circuit 24, so that the membrane switch circuit 24 generates a corresponding electronic signal.

In a case that the key structure 2 is not depressed, the keycap 21 of the key structure 2 is located at a first height (not shown). Whereas, when the key structure 2 is depressed, a downward pressing force is exerted on the keycap 21, and the elastic element 23 is compressed in response to the pressing force. Moreover, as the keycap 21 is depressed, the inner frame 221 and the outer frame 222 of the scissors-type connecting member 22 are correspondingly swung with the keycap 21. Consequently, the inner frame 221 and the outer frame 222 are parallel with each other. At the same time, the membrane switch circuit 24 on the base plate 25 is pressed and triggered by the elastic element 23. Consequently, the membrane switch circuit 24 generates a corresponding electronic signal. Meanwhile, the keycap 21 of the key structure 2 is descended from the first height to a second height (not shown). The difference between the first height and the second height indicates a travelling distance of the key structure 2.

In a case that the pressing force exerted on the keycap 21 is eliminated, the keycap 21 will be moved upwardly in response to a restoring force of the elastic element 23. As the keycap 21 is moved upwardly, the inner frame 221 and the outer frame 222 are towed by the keycap 21 and correspondingly rotated. Consequently, the keycap 21 is returned to its original position where the keycap 21 has not been depressed (i.e. at the first height).

From the above discussions, after the pressing force exerted on the keycap 21 is eliminated, the keycap 21 should be moved upwardly and returned to its original position (i.e. at the first height). For achieving this purpose, the elastic element 23 should provide a sufficient restoring force to push the keycap 21 back to its original position. In addition, the inner frame 221 and the outer frame 222 need to cooperate with each other to precisely control the upward moving action of the keycap 21 in the vertical direction. In other words, the performance of the scissors-type connecting member 22 is a very important factor that influences the quality and the use life of the key structure 2. Moreover, for combining the inner frame 221 with the outer frame 222, the user needs to prop open the outer frame 222 to widen the distance between the two openings 2221, which are respectively located at bilateral sides of the outer frame 222. Consequently, the rotating shaft 2211 can be successfully inserted into the openings 2221 to result in the combination between the inner frame 221 and the outer frame 222. The procedure of propping-open the outer frame 222 increases the assembling time of the key structure 2 and is detrimental to the throughput of the keyboard device. Moreover, since the outer frame 222 has the openings 2221, if the thickness of the key structure 2 is slimed, the whole structure of the outer frame 222 becomes weak and is easily damaged. In other words, the conventional scissors-type connecting member 22 is not suitable for slimness of the key structure 2.

SUMMARY OF THE INVENTION

The present invention provides an easily-assembled scissors-type connecting member and a key structure with such a scissors-type connecting member.

The present invention also provides a low-damage scissors-type connecting member and a key structure with such a scissors-type connecting member.

In accordance with an aspect of the present invention, there is provided a scissors-type connecting member. The scissors-type connecting member includes a first frame and a second frame. The first frame includes a rotating shaft and an extension structure. The rotating shaft is disposed on a first sidewall of the first frame. The extension structure is disposed on the first sidewall of the first frame and extended from the first sidewall to a ring-shaped periphery of the rotating shaft. The second frame is connected with the first frame and swingable relative to the first frame, and includes a receiving recess. The receiving recess is formed in a second sidewall of the second frame for accommodating the rotating shaft and the extension structure.

In an embodiment, the receiving recess includes a first storing part and a second storing part. The first storing part is formed in the second sidewall of the second frame for accommodating the rotating shaft, so that the rotating shaft is rotatable relative to the first storing part. The second storing part is formed in the second sidewall of the second frame and in communication with the first storing part for accommodating the extension structure. As the rotating shaft is rotated relative to the first storing part, the extension structure is moved along the second storing part.

In an embodiment, the second frame further includes a position-limiting wall. The position-limiting wall is arranged between the second sidewall of the second frame and the second storing part for limiting a movable range of the extension structure relative to the second storing part.

In an embodiment, the second frame further includes a guiding slant. The guiding slant is formed on a top surface of the second frame and in communication with the receiving recess for guiding the rotating shaft to be introduced into the receiving recess. As the rotating shaft is contacted with the top surface of the second frame, the rotating shaft is contacted with the guiding slant and further moved into the receiving recess along the guiding slant.

In an embodiment, the first frame further includes an auxiliary slant. The auxiliary slant is arranged between an axial surface of the rotating shaft and the ring-shaped periphery of the rotating shaft to be contacted with the guiding slant, thereby assisting in introducing the rotating shaft into the receiving recess. As the rotating shaft is contacted with the top surface of the second frame, the auxiliary slant is contacted with the guiding slant and moved along the guiding slant, so that the rotating shaft is introduced into the receiving recess.

In an embodiment, the rotating shaft and the extension structure are integrally formed with the first frame.

In an embodiment, the first frame is an inner frame, and the second frame is an outer frame. The first frame is coupled to an inner side of the second frame.

In an embodiment, the first frame is an outer frame, and the second frame is an inner frame. The second frame is coupled to an inner side of the first frame.

In accordance with another aspect of the present invention, there is provided a key structure. The key structure includes a base plate, a keycap, and a scissors-type connecting member. The keycap is disposed over the base plate. The scissors-type connecting member is arranged between the base plate and the keycap for connecting the base plate with the keycap, so that the keycap is movable upwardly or downwardly relative to the base plate. The scissors-type connecting member includes a first frame and a second frame. The first frame includes a rotating shaft and an extension structure. The rotating shaft is disposed on a first sidewall of the first frame. The extension structure is disposed on the first sidewall of the first frame and extended from the first sidewall to a ring-shaped periphery of the rotating shaft. The second frame is connected with the first frame and swingable relative to the first frame, and includes a receiving recess. The receiving recess is formed in a second sidewall of the second frame for accommodating the rotating shaft and the extension structure.

In an embodiment, the receiving recess includes a first storing part and a second storing part. The first storing part is formed in the second sidewall of the second frame for accommodating the rotating shaft, so that the rotating shaft is rotatable relative to the first storing part. The second storing part is formed in the second sidewall of the second frame and in communication with the first storing part for accommodating the extension structure. As the rotating shaft is rotated relative to the first storing part, the extension structure is moved along the second storing part.

In an embodiment, the second frame further includes a position-limiting wall. The position-limiting wall is arranged between the second sidewall of the second frame and the second storing part for limiting a movable range of the extension structure relative to the second storing part.

In an embodiment, the second frame further includes a guiding slant. The guiding slant is formed on a top surface of the second frame and in communication with the receiving recess for guiding the rotating shaft to be introduced into the receiving recess. As the rotating shaft is contacted with the top surface of the second frame, the rotating shaft is contacted with the guiding slant and further moved into the receiving recess along the guiding slant.

In an embodiment, the first frame further includes an auxiliary slant. The auxiliary slant is arranged between an axial surface of the rotating shaft and the ring-shaped periphery of the rotating shaft to be contacted with the guiding slant, thereby assisting in introducing the rotating shaft into the receiving recess. As the rotating shaft is contacted with the top surface of the second frame, the auxiliary slant is contacted with the guiding slant and moved along the guiding slant, so that the rotating shaft is introduced into the receiving recess.

In an embodiment, the rotating shaft and the extension structure are integrally formed with the first frame.

In an embodiment, the key structure further includes a membrane switch circuit and an elastic element. The membrane switch circuit is disposed on the base plate. When the membrane switch circuit is triggered, the membrane switch circuit generates a key signal. The elastic element is disposed on the membrane switch circuit. A lower portion of the elastic element is contacted with the membrane switch circuit. The elastic element is penetrated through the scissors-type connecting member. An upper portion of the elastic element is contacted with the keycap. When the elastic element is pushed by the keycap, the membrane switch circuit is triggered by the elastic element. When a pressing force exerted on the keycap is eliminated, an elastic force provided by the elastic element is exerted on the keycap.

In an embodiment, the first frame is an inner frame, and the second frame is an outer frame. The first frame is coupled to an inner side of the second frame.

In an embodiment, the first frame is an outer frame, and the second frame is an inner frame. The second frame is coupled to an inner side of the first frame.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
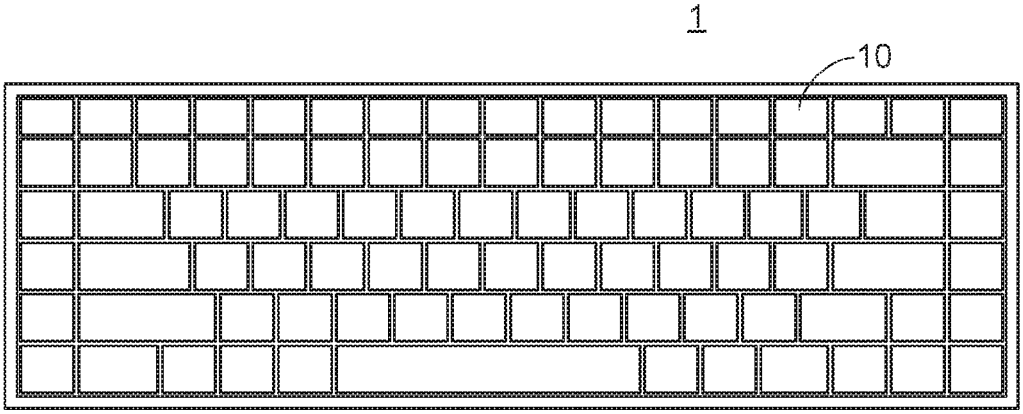
FIG.1 PRIOR ART
FIG. 1 is a schematic top view illustrating the outward appearance of a conventional keyboard device.
Figure 2:
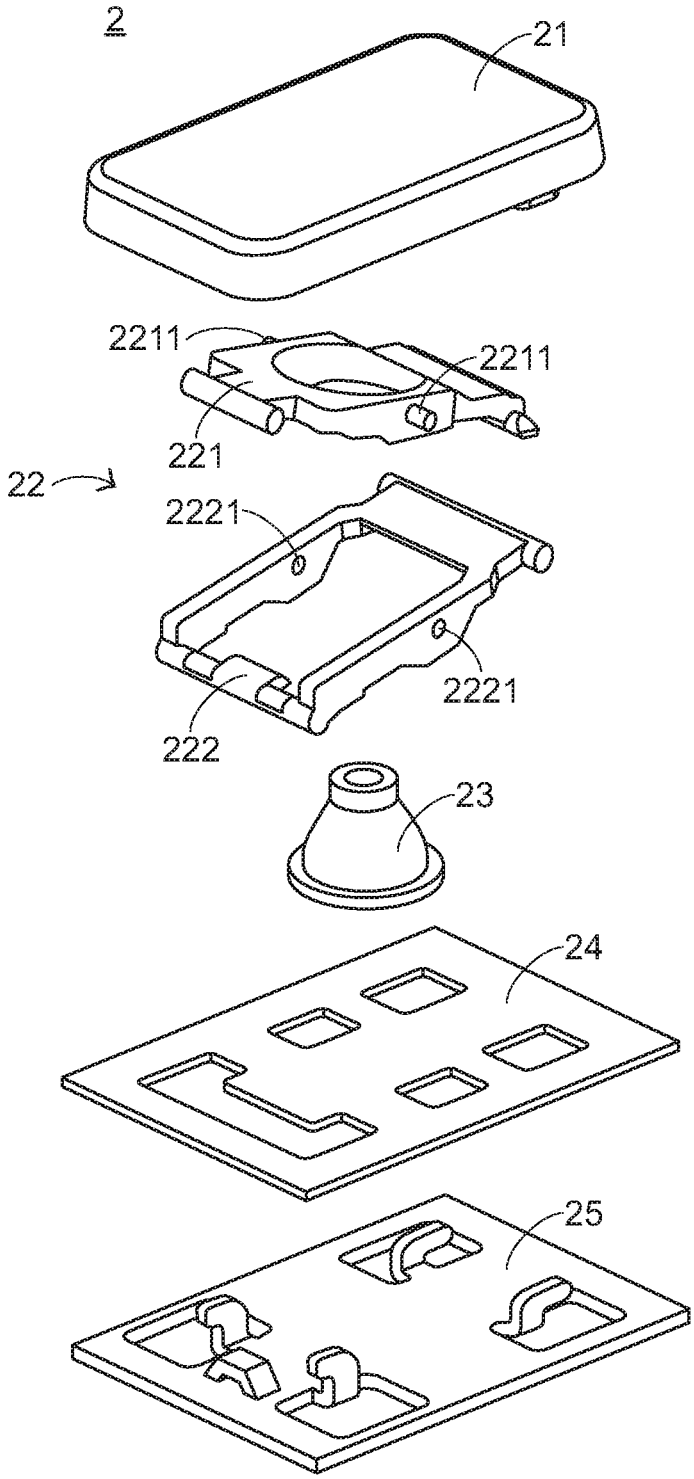
FIG.2 PRIOR ART
FIG. 2 is a schematic exploded view illustrating a key structure of a conventional keyboard device.
Figure 3:
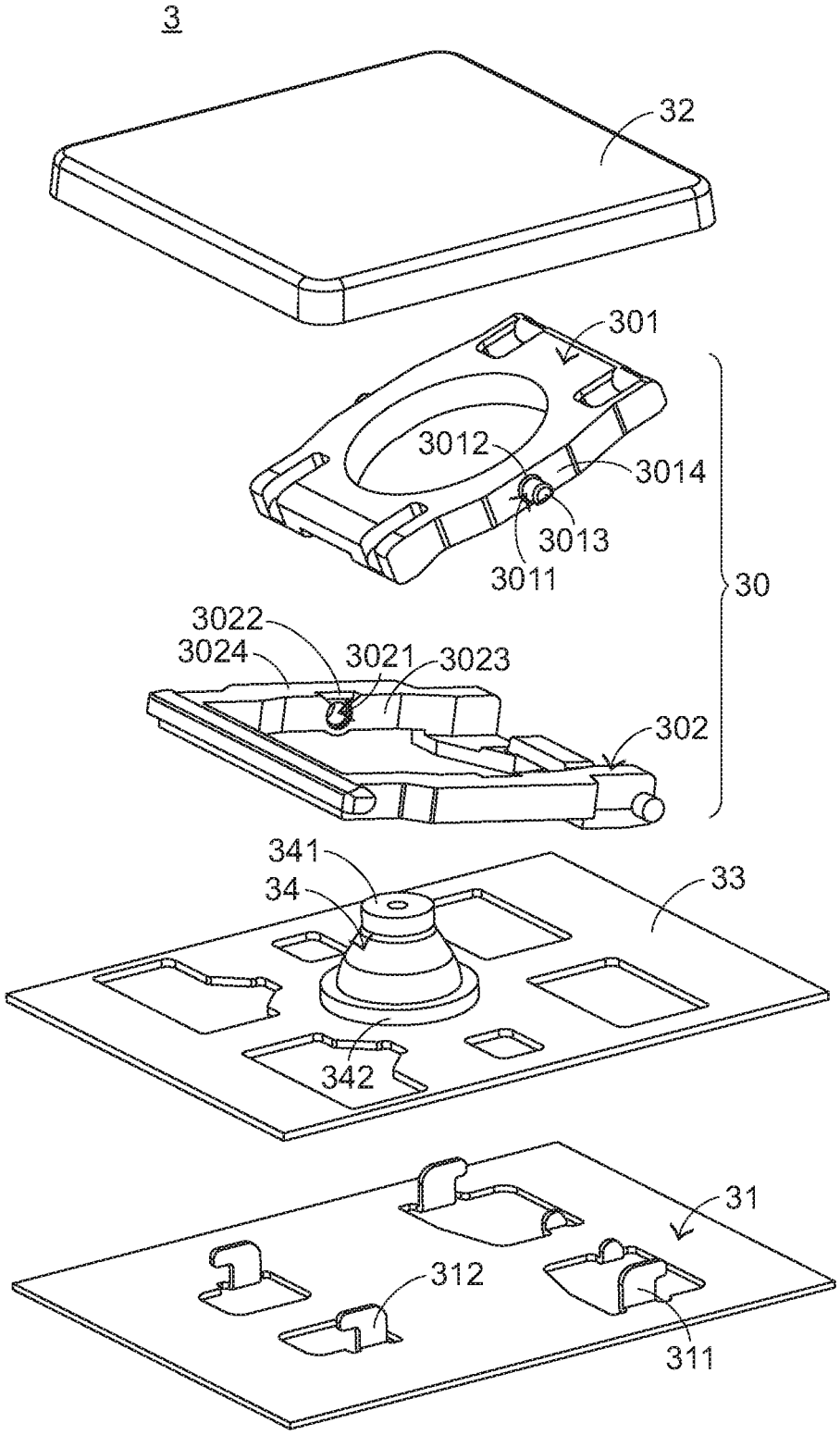
FIG. 3 is a schematic exploded view illustrating a key structure with a scissors-type connecting member according to a first embodiment of the present invention.
Figure 4:
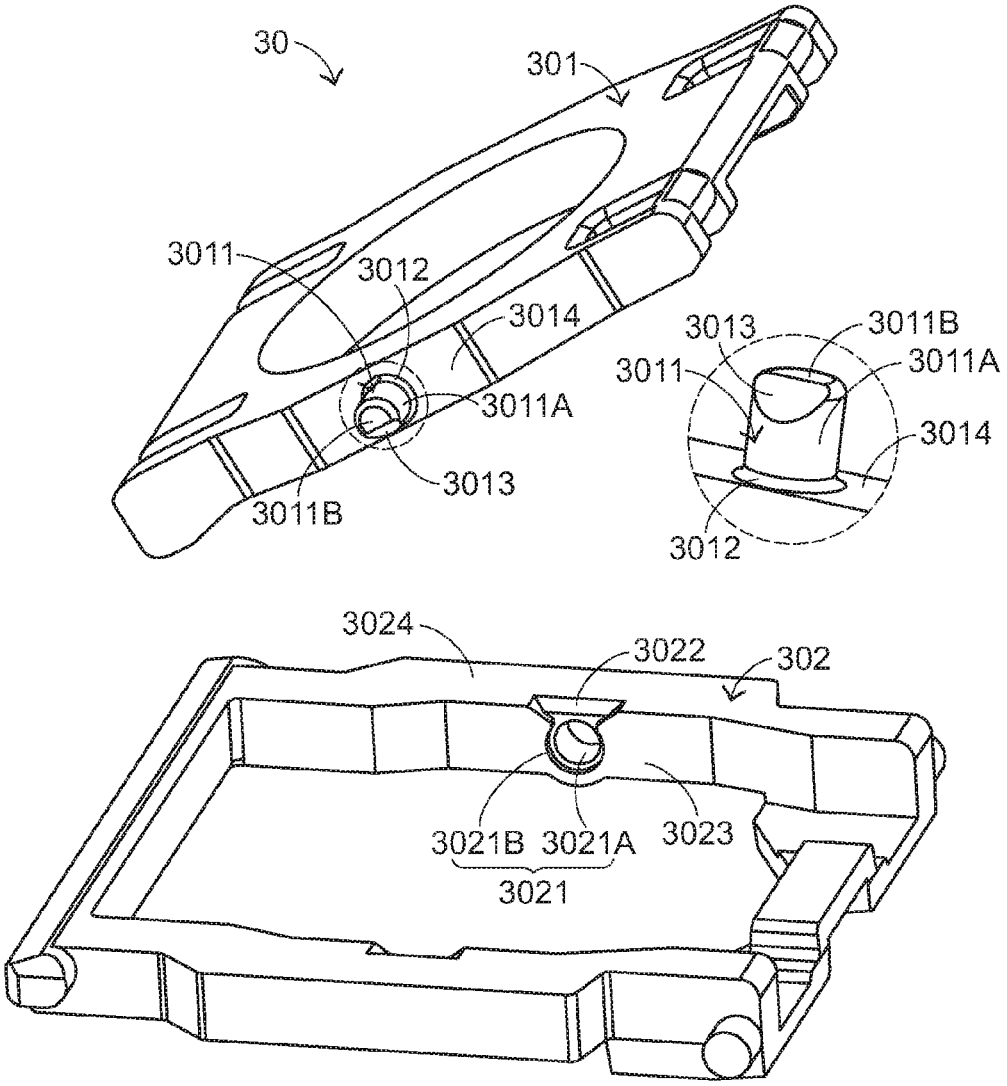
FIG. 4 is a schematic exploded view illustrating a first frame and a second frame of the scissors-type connecting member of the key structure according to the first embodiment of the present invention.

For obviating the drawbacks encountered from the prior art, the present invention provides a scissors-type connecting member and a key structure with such a scissors-type connecting member. Hereinafter, a key structure and a scissors-type connecting member thereof will be illustrated with reference to FIGS. 3 and 4. FIG. 3 is a schematic exploded view illustrating a key structure with a scissors-type connecting member according to a first embodiment of the present invention. FIG. 4 is a schematic exploded view illustrating a first frame and a second frame of the scissors-type connecting member of the key structure according to the first embodiment of the present invention. As shown in FIGS. 3 and 4, the key structure 3 comprises a scissors-type connecting member 30, a base plate 31, a keycap 32, a membrane switch circuit 33, and an elastic element 34. The scissors-type connecting member 30 is arranged between the keycap 32 and the membrane switch circuit 33. The scissors-type connecting member 30 comprises a first frame 301 and a second frame 302. The first frame 301 and the second frame 302 are connected with each other. In addition, the second frame 302 is swingable relative to the first frame 301. In this embodiment, the first frame 301 is an inner frame, and the second frame 302 is an outer frame, wherein the first frame 301 is coupled to an inner side of the second frame 302. Alternatively, in some other embodiments, the first frame is an outer frame, and the second frame is an inner frame, wherein the second frame is coupled to an inner side of the first frame.

Please refer to FIG. 3 again. The membrane switch circuit 33 is arranged between the base plate 31 and the elastic element 34. When the membrane switch circuit 33 is triggered, the membrane switch circuit 33 issues a key signal. The elastic element 34 is arranged between the keycap 32 and the membrane switch circuit 33. In addition, the elastic element 34 comprises an upper portion 341 and a lower portion 342. For combining the components of the key structure 3 together, the elastic element 34 is penetrated through a central hollow portion (not shown) of the first frame 301, the upper portion 341 of the elastic element 34 is contacted with the keycap 32, and the lower portion 342 of the elastic element 34 is contacted with the membrane switch circuit 33. The base plate 31 is disposed under the membrane switch 33. In addition, the base plate 31 comprises a first hook 311 and a second hook 312. The first hook 311 is located at a first side of the base plate 31 to be connected with a first end of the second frame 302. The second hook 312 is located at a second side of the base plate 31 to be connected with a second end of the first frame 301. Similarly, for connecting the keycap 32 with the scissors-type connecting member 30, the keycap 32 further comprises hooking structures (not shown) similar to the first hook 311 and the second hook 312 of the base plate 31. Via these hooking structures, a first end of the first frame 301 and a second end of the second frame 302 can be connected with the keycap 32.

The detailed configurations of the scissors-type connecting member 30 will be illustrated as follows. The first frame 301 of the scissors-type connecting member 30 comprises a rotating shaft 3011, an extension structure 3012, and an auxiliary slant 3013. The second frame 302 of the scissors-type connecting member 30 comprises a receiving recess 3021 and a guiding slant 3022. In the first frame 301, the rotating shaft 3011 is disposed on a first sidewall 3014 of the first frame 301. The extension structure 3012 is disposed on the first sidewall 3014 of the first frame 301, and extended from the first sidewall 3014 to a ring-shaped periphery 3011A of the rotating shaft 3011. The auxiliary slant 3013 is arranged between an axial surface 3011B of the rotating shaft 3011 and the ring-shaped periphery 3011A of the rotating shaft 3011. The auxiliary slant 3013 may be contacted with the guiding slant 3022 in order to assist in introducing the rotating shaft 3011 into the receiving recess 3021. For example, as the rotating shaft 3011 is contacted with a top surface 3024 of the second frame 302, the auxiliary slant 3013 may be contacted with the guiding slant 3022 and further moved along the guiding slant 3022. Consequently, the rotating shaft 3011 may be smoothly introduced into the receiving recess 3021. In this embodiment, the rotating shaft 3011, the extension structure 3012 and the auxiliary slant 3013 are integrally formed with the first frame 301. Moreover, the extension structure 3012 is disposed around the rotating shaft 3011. In other words, the extension structure 3012 is ring-shaped.

In the second frame 302, the receiving recess 3021 is formed in a second sidewall 3023 of the second frame 302. The receiving recess 3021 is used for accommodating the rotating shaft 3011 and the extension structure 3012. The receiving recess 3021 comprises a first storing part 3021A and a second storing part 3021B. The first storing part 3021A is formed in the second sidewall 3023 of the second frame 302 for accommodating the rotating shaft 3011, so that the rotating shaft 3011 is rotatable relative to the first storing part 3021A. The second storing part 3021B is formed in the second sidewall 3023 of the second frame 302 and in communication with the first storing part 3021A and the guiding slant 3022. The second storing part 3021B is used for accommodating the extension structure 3012. As the rotating shaft 3011 is rotated relative to the first storing part 3021A, the extension structure 3012 is moved along the second storing part 3021B. In this embodiment, the second storing part 3021B is a ring-shaped concave structure corresponding to the extension structure 3012. The guiding slant 3022 is formed on the top surface 3024 of the second frame 302 and in communication with the receiving recess 3021. The guiding slant 3022 is used for guiding the rotating shaft 3011 to be introduced into the receiving recess 3021. As the rotating shaft 3011 is contacted with the top surface 3024 of the second frame 302, the auxiliary slant 3013 may be contacted with the guiding slant 3022 and moved along the guiding slant 3022. Consequently, the rotating shaft 3011 is introduced into the receiving recess 3021.

Figure 5A:
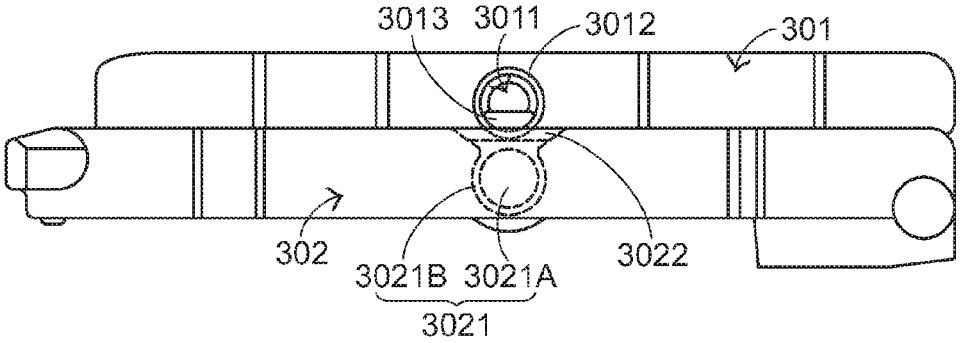
FIGS. 5A and 5B are schematic side views illustrating a process of assembling the scissors-type connecting member of the key structure according to the first embodiment of the present invention.
Figure 5B:
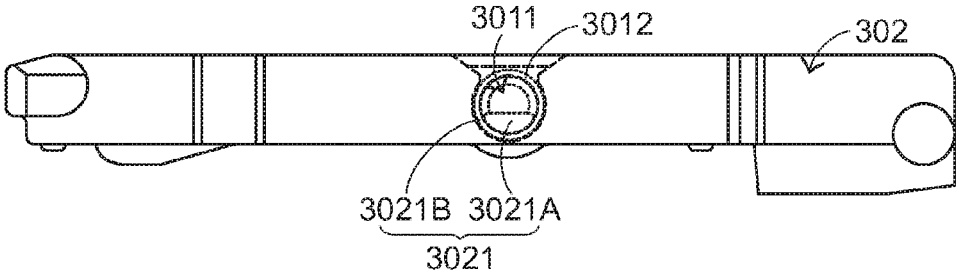

Hereinafter, a process of combining the first frame 301 with the second frame 302 will be illustrated with reference to FIGS. 4, 5A and 5B. FIGS. 5A and 5B are schematic side views illustrating a process of assembling the scissors-type connecting member of the key structure according to the first embodiment of the present invention. The process of assembling the scissors-type connecting member 30 by combining the first frame 301 with the second frame 302 comprises the following steps. Firstly, the first frame 301 is firstly stacked on the second frame 302, and the rotating shaft 3011 of the first frame 301 is aligned with the guiding slant 3022 of the second frame 302. Consequently, the auxiliary slant 3013 between the ring-shaped periphery 3011A and the axial surface 3011B of the rotating shaft 3011 is contacted with the guiding slant 3022 (see FIG. 5A). Then, a downward pressing force is exerted on the first frame 301. In response to the pressing force, the first frame 301 is moved downwardly. Meanwhile, due to the structures of the auxiliary slant 3013 and the guiding slant 3022, the rotating shaft 3011 is introduced into the receiving recess 3021 (see FIG. 5B). Especially, the rotating shaft 3011 is accommodated within the first storing part 3021A, and the extension structure 3012 is accommodated within the second storing part 3021B. Meanwhile, the scissors-type connecting member 30 is assembled.

Please refer to FIG. 3 again. As the keycap 32 of the key structure 3 with the scissors-type connecting member 30 is depressed, the second frame 302 of the scissors-type connecting member 30 is swung relative to the first frame 301. Consequently, the scissors-type connecting member 30 is switched from an open-scissors state to a folded state. Moreover, in response to the pressing force, the keycap 32 is moved downwardly to push against the elastic element 34, and thus the membrane switch circuit 33 is triggered by the elastic element 34 to generate a key signal. Whereas, when the pressing force exerted on the keycap 32 is eliminated, an elastic force provided by the elastic element 34 is acted on the keycap 32. Due to the elastic force, the second frame 302 is swung relative to the first frame 301, and the keycap 32 is returned to its original location where the keycap 32 has not been depressed. The operations of the key structure 3 with the scissors-type connecting member 30 have been described above.

From the above discussions, the extension structure 3012 of the first frame 301 is extended from the first sidewall 3014 to the ring-shaped periphery 3011A of the rotating shaft 3011. By means of the extension structure 3012, the structural strength of the rotating shaft 3011 is enhanced, and the possibility of causing damage of the rotating shaft 3011 is largely reduced. Moreover, since the second frame 302 comprises the first storing part 3021A and the second storing part 3021B corresponding to the rotating shaft 3011 and the extension structure 3012, respectively, the second frame 302 is rotatable relative to the first frame 301. Moreover, since the receiving recess 3021 and the guiding slant 3022 of the second frame 302 are in communication with each other, it is not necessary to previously prop open the outer frame to couple the inner frame to the inner side of the outer frame. In other words, the scissors-type connecting member 30 can be easily assembled.

Figure 6:
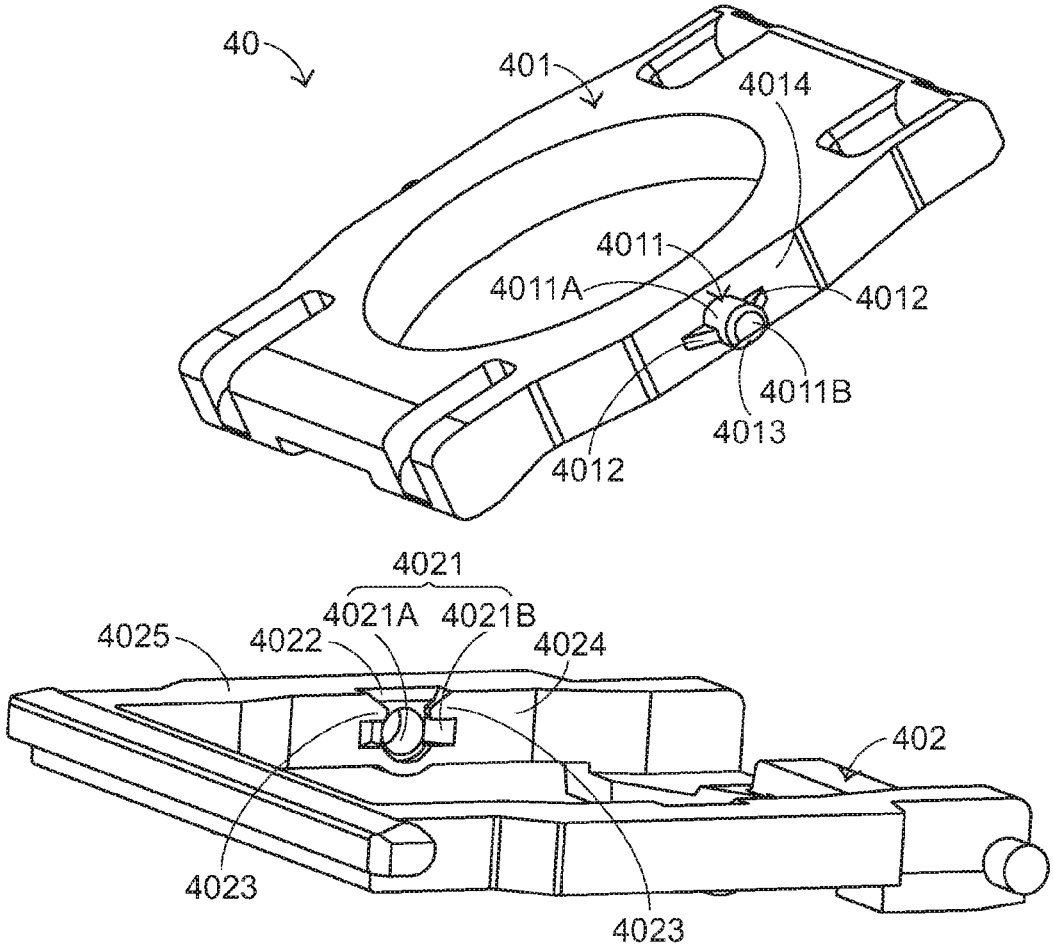
FIG. 6 is a schematic exploded view illustrating a first frame and a second frame of a scissors-type connecting member of a key structure according to a second embodiment of the present invention.

The present invention further provides a second embodiment of a key structure with a scissors-type connecting member. The base plate, the keycap, the membrane switch circuit and the elastic element included in the key structure of the second embodiment are similar to those of the first embodiment, and are not redundantly described herein. Hereinafter, the scissors-type connecting member 40 of the key structure according to the second embodiment of the present invention will be illustrated with reference to FIG. 6. FIG. 6 is a schematic exploded view illustrating a first frame and a second frame of a scissors-type connecting member of a key structure according to a second embodiment of the present invention. The scissors-type connecting member 40 comprises a first frame 401 and a second frame 402. The first frame 401 and the second frame 402 are connected with each other. In addition, the second frame 402 is swingable relative to the first frame 401. In this embodiment, the first frame 401 is an inner frame, and the second frame 402 is an outer frame, wherein the first frame 401 is coupled to an inner side of the second frame 402.

The first frame 401 comprises a rotating shaft 4011, an extension structure 4012, and an auxiliary slant 4013. The second frame 402 comprises a receiving recess 4021, a guiding slant 4022, and a position-limiting wall 4023. In the first frame 401, the rotating shaft 4011 is disposed on a first sidewall 4014 of the first frame 401. The extension structure 4012 is disposed on the first sidewall 4014 of the first frame 401, and extended from the first sidewall 4014 to a ring-shaped periphery 4011A of the rotating shaft 4011. The auxiliary slant 4013 is arranged between an axial surface 4011B of the rotating shaft 4011 and the ring-shaped periphery 4011A of the rotating shaft 4011. The auxiliary slant 4013 may be contacted with the guiding slant 4022 in order to assist in introducing the rotating shaft 4011 into the receiving recess 4021. For example, as the rotating shaft 4011 is contacted with a top surface 4025 of the second frame 402, the auxiliary slant 4013 may be contacted with the guiding slant 4022 and further moved along the guiding slant 4022. Consequently, the rotating shaft 4011 may be smoothly introduced into the receiving recess 4021. In this embodiment, the rotating shaft 4011, the extension structure 4012 and the auxiliary slant 4013 are integrally formed with the first frame 401.

In this embodiment, the extension structure 4012 is a triangular bulge, which is extended from the first sidewall 4014 to the ring-shaped periphery 4011A of the rotating shaft 4011. Especially, a first side of the extension structure 4012 near the first sidewall 4014 is longer than a second side of the extension structure 4012 near the ring-shaped periphery 4011A.

In the second frame 402, the receiving recess 4021 is formed in a second sidewall 4024 of the second frame 402. The receiving recess 4021 is used for accommodating the rotating shaft 4011 and the extension structure 4012. The receiving recess 4021 comprises a first storing part 4021A and a second storing part 4021B. The first storing part 4021A is formed in the second sidewall 4024 of the second frame 402 for accommodating the rotating shaft 4011, so that the rotating shaft 4011 is rotatable relative to the first storing part 4021A. The second storing part 4021B is formed in the second sidewall 4024 of the second frame 402 and in communication with the first storing part 4021A and the guiding slant 4022. The second storing part 4021B is used for accommodating the extension structure 4012. When the rotating shaft 4011 is rotated relative to the first storing part 4021A, the extension structure 4012 is moved along the second storing part 4021B. The position-limiting wall 4023 is arranged between the second sidewall 4024 of the second frame 402 and the second storing part 4021B for limiting a movable range of the extension structure 4012 relative to the second storing part 4021B. In this embodiment, the position-limiting wall 4023 is integrally formed with the second frame 402. The second storing part 4021B is a concave structure corresponding to the triangular bulge of the extension structure 4012. The guiding slant 4022 is formed on the top surface 4025 of the second frame 402 and in communication with the receiving recess 4021. The guiding slant 4022 is used for guiding the rotating shaft 4011 to be introduced into the receiving recess 4021. As the rotating shaft 4011 is contacted with the top surface 4025 of the second frame 402, the auxiliary slant 4013 may be contacted with the guiding slant 4022 and moved along the guiding slant 4022. Consequently, the rotating shaft 4011 is introduced into the receiving recess 4021.

The process of combining the first frame 401 with the second frame 402 is similar to that of the first embodiment except that a larger pressing force is required after the rotating shaft 4011 is transferred through the guiding slant 4022. In response to the larger pressing force, the extension structure 4012 can be transferred through the position-limiting wall 4023 to be accommodated within the second storing part 4021B.

From the above discussions, the scissors-type connecting member and the key structure according to the second embodiment of the present invention also have the components similar to the first embodiment for enhancing the structural strength of the rotating shaft 4011 and facilitating combination of the first frame 401 and the second frame 402. Moreover, the scissors-type connecting member of the second embodiment further comprises the position-limiting wall 4023 for limiting the rotatable range of the extension structure. Consequently, as the second frame 402 is rotated relative to the first frame 401 by a specified angle, the second frame 402 fails to be further rotated. In other words, the scissors-type connecting member 40 can be maintained in the open-scissors state, and thus the scissors-type connecting member 40 can be easily combined with the base plate and the keycap.

From the above descriptions, the present invention provides a scissors-type connecting member and a key structure with such a scissors-type connecting member. The scissors-type connecting member comprises a first frame and a second frame. A receiving recess is formed in the second frame to replace the opening of the conventional scissors-type connecting member. Consequently, the structural strength of the second frame is enhanced, and the possibility of causing damage of the second frame is largely reduced. Moreover, since the extension structure is arranged between the rotating shaft and the first sidewall of the first frame, the structural strength of the rotating shaft is enhanced, and the possibility of causing damage of the rotating shaft is largely reduced. In some embodiments, the scissors-type connecting member further comprises the position-limiting wall, so that the rotatable range of the extension structure is limited by the position-limiting wall. Since the rotating range of the extension structure is limited by the position-limiting wall, the scissors-type connecting member can be maintained in the open-scissors state. Consequently, the structures of the scissors-type connecting member can facilitate the assemblage of the key structure. Moreover, an auxiliary slant is arranged between the axial surface and the ring-shaped periphery of the rotating shaft and located at a specified side (e.g. a bottom side) of the rotating shaft, but no auxiliary slant is located at another side (e.g. a top side) of the rotating shaft. During the process of combining the first frame with the second frame, the auxiliary slant may be considered as a foolproof structure for preventing the first frame to be stacked on the second frame in a wrong direction. Consequently, the possibility of erroneously combining the first frame with the second frame will be eliminated.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A scissors-type connecting member, comprising:

a first frame comprising a rotating shaft and an extension structure, wherein said rotating shaft is disposed on a first sidewall of said first frame, wherein said extension structure is disposed on said first sidewall of said first frame and extended from said first sidewall to a ring-shaped periphery of said rotating shaft; and a second frame connected with said first frame and swingable relative to said first frame, and comprising a receiving recess, wherein said receiving recess is formed in a second sidewall of said second frame for accommodating said rotating shaft and said extension structure, wherein said second frame further comprises a guiding slant, wherein said guiding slant is formed on a top surface of said second frame and in communication with said receiving recess for guiding said rotating shaft to be introduced into said receiving recess, wherein as said rotating shaft is contacted with said top surface of said second frame, said rotating shaft is contacted with said guiding slant and further moved into said receiving recess along said guiding slant and wherein said first frame further comprises an auxiliary slant, wherein said auxiliary slant is arranged between an axial surface of said rotating shaft and said ring-shaped periphery of said rotating shaft to be contacted with said guiding slant, thereby assisting in introducing said rotating shaft into said receiving recess, wherein as said rotating shaft is contacted with said top surface of said second frame, said auxiliary slant is contacted with said guiding slant and moved along the guiding slant, so that said rotating shaft is introduced into said receiving recess.

2. The scissors-type connecting member according to claim 1, wherein said receiving recess comprises:

a first storing part formed in said second sidewall of said second frame for accommodating said rotating shaft, so that said rotating shaft is rotatable relative to said first storing part; and a second storing part formed in said second sidewall of said second frame and in communication with said first storing part for accommodating said extension structure, wherein as said rotating shaft is rotated relative to said first storing part, said extension structure is moved along said second storing part.

3. The scissors-type connecting member according to claim 2, wherein said second frame further comprises a position-limiting wall, wherein said position-limiting wall is arranged between said second sidewall of said second frame and said second storing part for limiting a movable range of said extension structure relative to said second storing part.

4. The scissors-type connecting member according to claim 1, wherein said rotating shaft and said extension structure are integrally formed with said first frame.

5. The scissors-type connecting member according to claim 1, wherein said first frame is an inner frame, and said second frame is an outer frame, wherein said first frame is coupled to an inner side of said second frame.

6. The scissors-type connecting member according to claim 1, wherein said first frame is an outer frame, and said second frame is an inner frame, wherein said second frame is coupled to an inner side of said first frame.

7. A key structure with a scissors-type connecting member, said key structure comprising:

a base plate;

a keycap disposed over said base plate; and said scissors-type connecting member arranged between said base plate and said keycap for connecting said base plate with said keycap, so that said keycap is movable upwardly or downwardly relative to said base plate, wherein said scissors-type connecting member comprises:

a first frame comprising a rotating shaft and an extension structure, wherein said rotating shaft is disposed on a first sidewall of said first frame, wherein said extension structure is disposed on said first sidewall of said first frame and extended from said first sidewall to a ring-shaped periphery of said rotating shaft; and a second frame connected with said first frame and swingable relative to said first frame, and comprising a receiving recess, wherein said receiving recess is formed in a second sidewall of said second frame for accommodating said rotating shaft and said extension structure, wherein said second frame further comprises a guiding slant, wherein said guiding slant is formed on a top surface of said second frame and in communication with said receiving recess for guiding said rotating shaft to be introduced into said receiving recess, wherein as said rotating shaft is contacted with said top surface of said second frame, said rotating shaft is contacted with said guiding slant and further moved into said receiving recess along said guiding slant and wherein said first frame further comprises and auxiliary slant, wherein said auxiliary slant is arranged between an axial surface of said rotating shaft and said ring-shaped periphery of said rotating shaft to be contacted with said guiding slant, thereby assisting in introducing said rotating shaft into said receiving recess, wherein as said rotating shaft is contacted with said top surface of said second frame, said auxiliary slant is contacted with said guiding slant and moved along the guiding slant, so that said rotating shaft is introduced into said receiving recess.

8. The key structure according to claim 7, wherein said receiving recess comprises:

a first storing part formed in said second sidewall of said second frame for accommodating said rotating shaft, so that said rotating shaft is rotatable relative to said first storing part; and a second storing part formed in said second sidewall of said second frame and in communication with said first storing part for accommodating said extension structure, wherein as said rotating shaft is rotated relative to said first storing part, said extension structure is moved along said second storing part.

9. The key structure according to claim 8, wherein said second frame further comprises a position-limiting wall, wherein said position-limiting wall is arranged between said second sidewall of said second frame and said second storing part for limiting a movable range of said extension structure relative to said second storing part.

10. The key structure according to claim 7, wherein said rotating shaft and said extension structure are integrally formed with said first frame.

11. The key structure according to claim 7, further comprising:

a membrane switch circuit disposed on said base plate, wherein when said membrane switch circuit is triggered, said membrane switch circuit generates a key signal; and an elastic element disposed on said membrane switch circuit, wherein a lower portion of said elastic element is contacted with said membrane switch circuit, said elastic element is penetrated through said scissors-type connecting member, and an upper portion of said elastic element is contacted with said keycap, wherein when said elastic element is pushed by said keycap, said membrane switch circuit is triggered by said elastic element, wherein when a pressing force exerted on said keycap is eliminated, an elastic force provided by said elastic element is exerted on said keycap.

12. The key structure according to claim 7, wherein said first frame is an inner frame, and said second frame is an outer frame, wherein said first frame is coupled to an inner side of said second frame.

13. The key structure according to claim 7, wherein said first frame is an outer frame, and said second frame is an inner frame, wherein said second frame is coupled to an inner side of said first frame.

* * * * *